US010208517B2

(12) United States Patent
Lucci et al.

(10) Patent No.: US 10,208,517 B2
(45) Date of Patent: Feb. 19, 2019

(54) WINDOW BALANCE ASSEMBLY INCLUDING SASH SUPPORT BRACKET

(71) Applicant: Caldwell Manufacturing Company North America, LLC, Rochester, NY (US)

(72) Inventors: Robert M. Lucci, Rochester, NY (US); Andrew Baglio, Rochester, NY (US)

(73) Assignee: Caldwell Manufacturing Company North America, LLC, Rochester, NY (US)

( * ) Notice: Subject to any disclaimer, the term of this patent is extended or adjusted under 35 U.S.C. 154(b) by 83 days.

(21) Appl. No.: 15/468,517

(22) Filed: Mar. 24, 2017

(65) Prior Publication Data

US 2017/0292303 A1 Oct. 12, 2017

Related U.S. Application Data

(60) Provisional application No. 62/321,256, filed on Apr. 12, 2016.

(51) Int. Cl.
*E05D 13/00* (2006.01)
*E05D 15/18* (2006.01)
*E05D 15/20* (2006.01)

(52) U.S. Cl.
CPC ..... *E05D 13/1276* (2013.01); *E05D 13/1292* (2013.01); *E05D 15/18* (2013.01); *E05D 15/20* (2013.01); *E05Y 2900/148* (2013.01)

(58) Field of Classification Search
CPC ..... E05D 13/1276; E05D 13/1292
USPC ..... 16/197
See application file for complete search history.

(56) References Cited

U.S. PATENT DOCUMENTS 4,953,258 A * 9/1990 Mennuto ..... E05D 13/1276 16/193
4,961,247 A * 10/1990 Leitzel ..... E05D 13/1276 16/193
5,353,548 A * 10/1994 Westfall ..... E05D 13/1276 16/197
5,463,793 A * 11/1995 Westfall ..... E05D 13/1276 16/197
8,561,260 B2 * 10/2013 Baker ..... E05D 13/1276 16/193
9,995,071 B2 * 6/2018 Kunz ..... E05D 13/08
2015/0361701 A1 * 12/2015 Steen ..... E05D 13/1276 49/506
2015/0361702 A1 * 12/2015 Kellum, III ..... E05D 13/1276 16/200
2016/0298368 A1 * 10/2016 Kunz ..... E05D 13/08
(Continued)

*Primary Examiner* — Jeffrey O'Brien
(74) *Attorney, Agent, or Firm* — Harness, Dickey & Pierce, P.L.C.

(57) ABSTRACT

A moving coil, constant force, curl spring window balance assembly for installation in a hung window assembly comprising a sash is disclosed. The window balance assembly can include a carrier, a mounting bracket, a curl spring and a sash support bracket. The sash support bracket can be positioned intermediate the carrier and the mounting bracket. The sash support bracket can selectively engage at least one of the carrier or the mounting bracket. The sash support bracket is operable to supplement the counterbalance or holding force provided by the curl spring of the window balance assembly against the weight of the sash when the sash is in a raised position.

14 Claims, 5 Drawing Sheets

(56) References Cited

U.S. PATENT DOCUMENTS

| | | | | |
|---|---|---|---|---|
| 2016/0298369 | A1* | 10/2016 | Kunz | E05D 13/04 |
| 2017/0145722 | A1* | 5/2017 | Kellum, III | E05D 13/1292 |
| 2018/0291660 | A1* | 10/2018 | Kellum | E05D 13/1276 |
| 2018/0291661 | A1* | 10/2018 | Baker | E05D 13/1276 |

* cited by examiner

WINDOW BALANCE ASSEMBLY INCLUDING SASH SUPPORT BRACKET

CROSS-REFERENCE TO RELATED APPLICATIONS

This application claims the benefit of U.S. Provisional Application No. 62/321,256, filed on Apr. 12, 2016. The entire disclosure of the above application is incorporated herein by reference.

FIELD

The present disclosure relates to window balance assemblies, and more particularly to a mounting bracket and carrier assembly including a curl spring.

BACKGROUND

This section provides background information related to the present disclosure which is not necessarily prior art.

Modern windows in residential, commercial and industrial buildings may include one or more window sashes that are movable within a window jamb. Hung windows include window sashes that move vertically to open and close and often include two or more window balance assemblies. The balance assemblies bias the window sash upward (i.e., toward an open position for a lower sash or toward a closed position for an upper sash) to assist a user in moving the window sash and to retain the window sash at a position selected by the user.

Moving coil, constant-force window balance assemblies for hung windows are known. Such a window balance assembly can include a curl spring which produces a constant force or tension of a recommended or rated value as it is linearly extended (i.e., uncurled) and retracted (i.e., curled). The spring force correlates to a weight range of window sashes that can be accommodated by the window balance assembly.

However, in a moving coil, constant force window balance assembly (such as shown in FIG. 2A), when the curl spring is retracted less than a minimum retracted length, the curl spring may not produce a spring force at least equal to the rated constant force value. See FIGS. 2B and 2C. Consequently, if movement of a window sash causes the curl spring to retract less than its minimum retracted length (e.g., a lower sash fully-opened or an upper sash fully-closed), the window balance assembly may be incapable of producing a counter-balance or holding force sufficient to retain the window sash in that position.

SUMMARY

This section provides a general summary of the disclosure, and is not a comprehensive disclosure of its full scope or all of its features.

In one form, the present disclosure provides a moving coil, constant force, curl spring window balance assembly for installation in a hung window assembly. The window balance assembly may include a carrier, a spring element, a mounting bracket and a sash support bracket. The spring element may include first and second portions. The first portion may be coupled to the carrier. The mounting bracket may engage the second portion of the spring element. The sash support bracket may selectively engage the carrier. The mounting bracket may be fastened to a jamb wall when installed in a hung window assembly.

The sash support bracket may supplement the counter-balance or holding force provided by the curl spring of the window balance assembly against the weight of the sash when the sash is in a raised position (e.g., a lower sash in a raised and open position, or an upper sash in a raised and closed position) and prevent the sash from drifting downward under the force of gravity. In addition, the sash support can provide at least one of an audible and tactile feedback to a user of the window balance assembly to indicate the position of the sash in a window frame.

In another form, the sash support bracket may be fastened to a jamb wall when installed in a hung window assembly.

In still another form, the sash support bracket may selectively engage the mounting bracket and be operatively coupled to the carrier.

In still another form, the mounting bracket may selectively engage directly to the carrier.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

Figure 1:
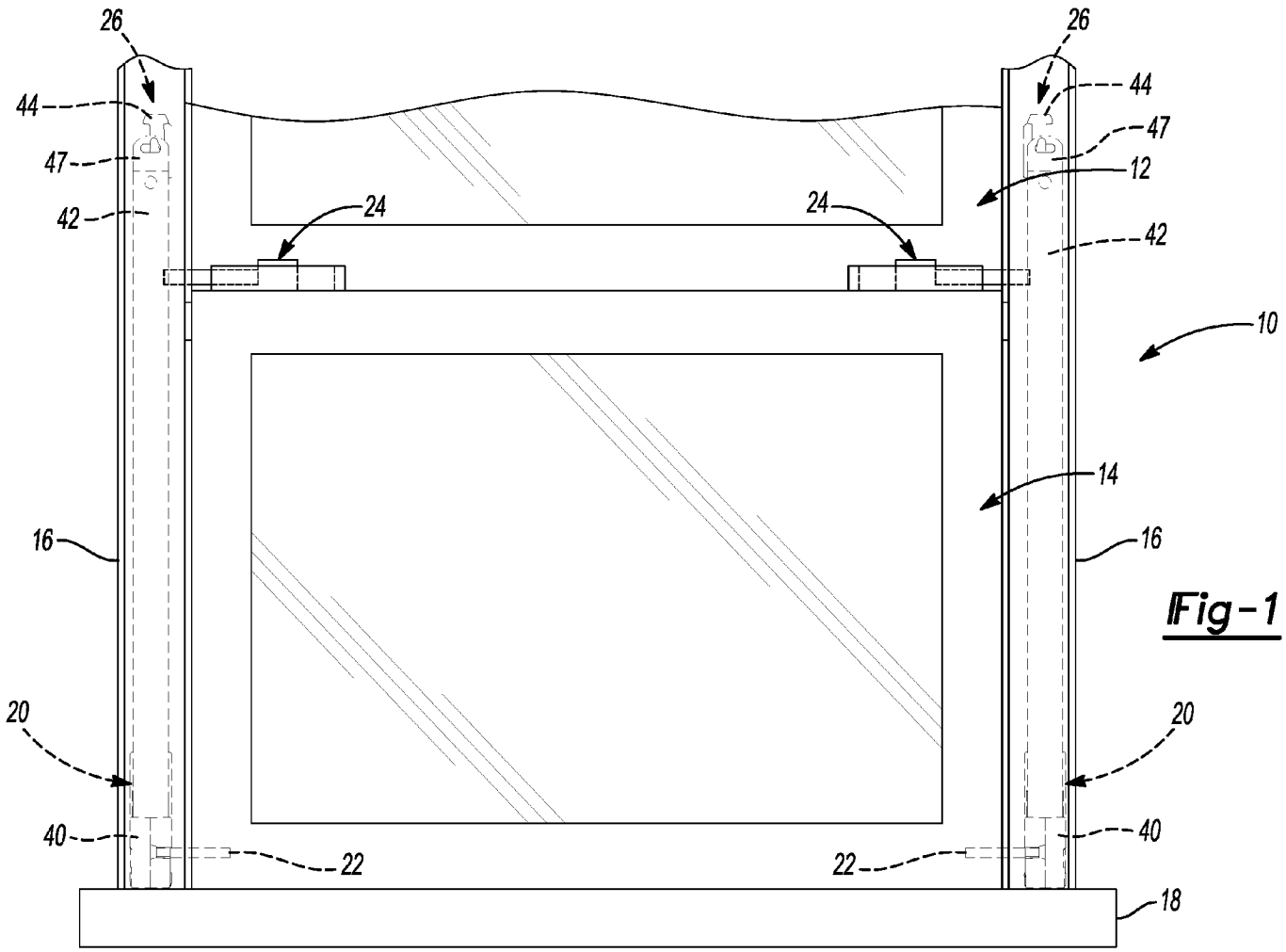
FIG. 1 is a front view of a window assembly including a plurality of moving-coil, constant force window balance assemblies.

With reference to FIG. 1, a window assembly 10 is provided that may include an upper sash 12, a lower sash 14, a pair of window jambs 16, a window sill 18, and two or more window balance assemblies 20. In the particular embodiment illustrated in FIG. 1, the upper sash 12 is fixed relative to the window sill 18 (i.e., in a single hung window assembly). However, in some embodiments, the upper sash 12 may be movable relative to the window sill 18 between a raised or closed position and a lowered or open position (i.e., in a double hung window assembly). The lower sash 14 may be raised and lowered between open and closed positions and may be connected to the window balance assemblies 20 which assist a user in opening the lower sash 14 and maintain the lower sash 14 in a desired position relative to the window sill 18.

The lower sash 14 may include a pair of pivot bars 22 and a pair of tilt latch mechanisms 24. The pivot bars 22 may extend laterally outward in opposing directions from a lower portion of the lower sash 14 and may engage corresponding ones of the window balance assemblies 20, as will be subsequently described. The tilt latch mechanisms 24 may extend laterally outward in opposing directions from an upper portion of the lower sash 14 and may selectively engage corresponding ones of the window jambs 16. The tilt latch mechanisms 24 may be selectively actuated to allow the lower sash 12 to pivot about the pivot bars 22 relative to the window jambs 16 to facilitate cleaning of an exterior side of the window assembly 10, for example.

It will be appreciated that in a double hung window assembly, the upper sash 12 may also be connected to two or more window balance assemblies to assist the user in opening the upper sash 12 and maintaining the upper sash 12 in a selected position relative to the window sill 18. In such a window assembly, the upper sash 12 may also include tilt latches and pivot bars to allow the upper sash 12 to pivot relative to the window jambs 16 in the manner described above.

Each of the window jambs 16 may include a jamb channel 26 defined by a first wall, a second wall opposite the first wall, and third and fourth walls disposed perpendicular to the first and second walls as is known in the art. The first wall may include a vertically extending slot adjacent the lower sash 14. The window balance assembly 20 may be installed within the jamb channel 26. The pivot bar 22 may extend through the slot 36 and into the jamb channel 26 to engage the window balance assembly 20. The tilt latch mechanism 24 may also selectively engage the slot to lock the lower sash 14 in an upright position (FIG. 1).

Figure 2A:
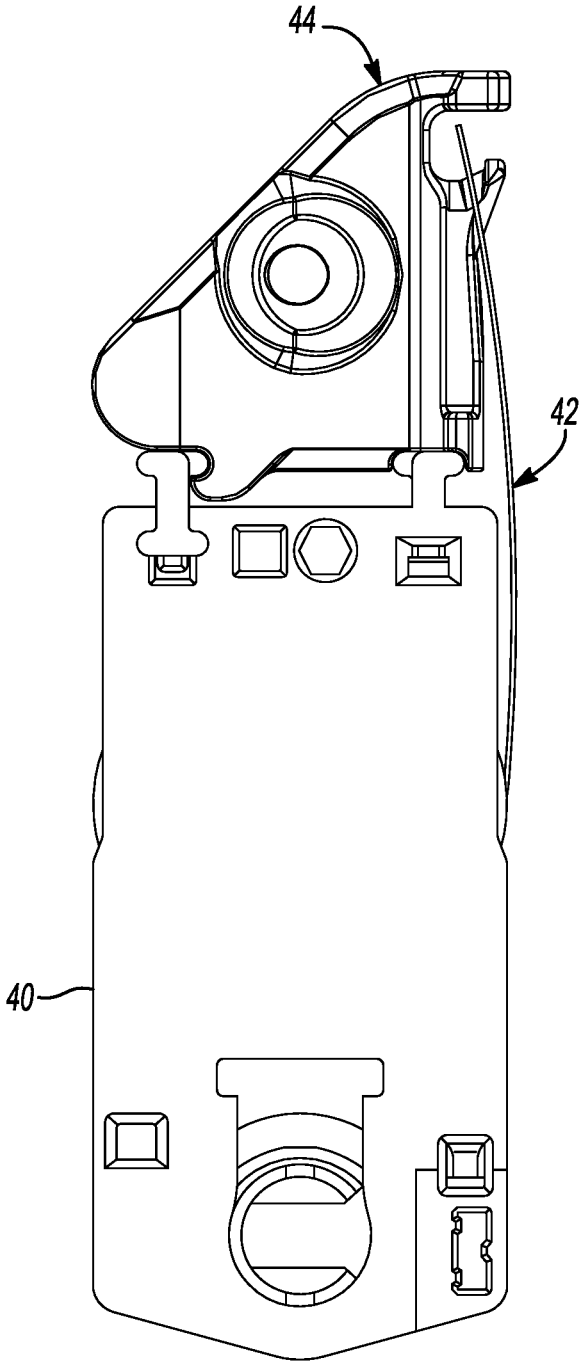
Fig-2A PRIOR ART
FIG. 2A shows a moving-coil, constant force window balance in a shipping configuration.

Each of the window balance assemblies 20, 20', 20" may include a carrier 40, a curl spring 42, and a mounting bracket 44, 44'. The window balance assemblies 20, 20', 20" may be initially assembled and shipped in an uninstalled or shipping configuration (e.g., similar to that shown in FIGS. 2A and 5) and may be subsequently installed onto the window assembly 10 and placed in an installed configuration by a window manufacturer, a construction or renovation contractor, or a homeowner, for example.

The carrier 40 (also referred to as a shoe) may engage the lower sash 14 and house a curled portion of the curl spring 42. The mounting bracket 44 may engage an uncurled end portion 47 of the curl spring 42 and may be fixed relative to the window jamb 16. The curl spring 42 may resist being uncurled such that the curl spring 42 exerts an upward force on the carrier 40, thereby biasing the lower sash 14 toward the open position.

The carrier 40 may include a first housing portion, a second housing portion, and a receiver. The first and second housing portions may be identical components that fit together to form a housing for the curl spring and the receiver. Forming the first and second housing portions as identical components can reduce the total number of different individual components that must be manufactured and facilitate poka-yoke assembly of the carrier 40. That is, assembly of the carrier 40 is simplified in that a worker need not be concerned with selecting the correct one of each of a pair of different mating components to assemble together.

Each of the first and second housing portions may include an exterior face, an interior face, a top end, a bottom end, a first side, and a second side. An aperture disposed proximate the bottom end may extend through the exterior and interior faces and may rotatably engage the receiver. An arcuate recess formed in the interior face may be concentric with the aperture and may partially surround the aperture. A first slot in communication with the aperture may be formed in the exterior face and may extend vertically upward from the aperture.

A barbed protuberance may be disposed at or proximate to the first side and may extend outward from the interior face. A second slot may be formed in the second side generally opposite the barbed protuberance such that when the first and second housing portions are assembled together, the barbed protuberances may engage the second slots. The length of the barbed protuberance may be sufficient to allow the first and second housing portions to move relative to each other between a first position and a second position without disengaging each other, as will be subsequently described.

The interior face may include generally cylindrical recesses. When the first and second housing portions are assembled together, the cylindrical recesses cooperate with each other to receive the curled portion of the curl spring. Openings in communication with the recess may be formed in the first and second ends through which the uncurled portion 47 of the curl spring may extend toward the mounting bracket 44, 44'.

The first and second housing portions may also include a projection 80 and a third slot disposed at the top end. The projection 80 may extend from the exterior face beyond the interior face and may include a generally I-shaped cross-section having upper and lower flanges 84, 86. The third slots may be sized and shaped to enable the third slots of the first housing portion and the second housing portion to slidably engage the lower flanges of the second housing portion and the first housing portion, respectively. In a similar manner, pegs and apertures formed in the interior face of the first and second housing portions may be sized and positioned to slidably engage each other when the first and second housing portions are assembled together.

The receiver may be a generally cylindrical member including slotted recesses formed in each end thereof and an annular cam extending around a portion of the perimeter of the receiver. One of the recesses of each of the window balance assemblies 20 may receive a corresponding one of the pivot bars 22 extending from the lower sash 14. As described above, the receiver may be rotatable within the aperture to allow the lower sash 14 to pivot about the pivot bar 22 between an upright position and a tilted position. The angular span of the cam may correspond to the angular span of the arcuate recess that partially surrounds the aperture in the first and second housing portions such that when the lower sash 14 is in the upright position, the cam fits within the arcuate recess.

When the receiver is oriented such that the slotted recess is oriented horizontally relative to the carrier 40, the cam may be fully received within the arcuate recess. When the cam is received in the arcuate recess, the first and second housing portions are allowed to fully close together. In this configuration, the carrier 40 is in an unlocked or unrestricted position, such that the carrier 40 may be generally unrestricted from moving upward and downward in the window jamb 16 as the lower sash 14 moves between the open and closed positions.

When the lower sash 14 is tilted relative to the window jamb 16, the pivot bar 22 rotates the receiver toward the orientation, in which the slotted recess is oriented vertically and is generally aligned with the first slot in the carrier 40. Rotating the receiver in this manner moves the cam out of the arcuate recess and causes the cam to force the interior faces of the first and second housing portions away from each other. In this manner, the exterior faces of the first and second housing portions are forced against the first and second walls of the jamb channel 26. Forcing the exterior faces outward against the first and second walls creates friction that may be sufficient to lock the carrier 40 in place relative to the jamb channel 26. Accordingly, when the lower sash 14 is in a tilted position, the window balance assembly 20 may be prevented from exerting a net upward force on the lower sash 14.

When the carrier 40 is locked in place within the jamb channel 26, the lower sash 14 can be removed from the window assembly 10 for maintenance or replacement, for example. To remove the lower sash 14, the pivot bars 22 can be removed from the receivers by moving the pivot bars 22 upward out of the slotted recesses and into the first slot in the carriers 40. Thereafter, the pivot bars 22 can be removed from the window balance assemblies 20 so that the lower sash 14 can be removed from the window assembly 10.

The opposite procedure may be employed to install the lower sash 14 into the window assembly 10. That is, with the lower sash 14 tilted relative to the upper sash 12, the pivot bars 22 may be inserted into the first slots in the carrier 40 and lowered into engagement with the slotted recesses in the receivers. The lower sash 14 may then be pivoted to the upright position relative to the upper sash 12. As described above, rotating the receiver allows the first and second housing portions to fully close together, thereby reducing or eliminating friction between the carrier 40 and the jamb channel 26 to allow unrestricted movement of the carrier 40 therein.

Figures 2B, 2C:
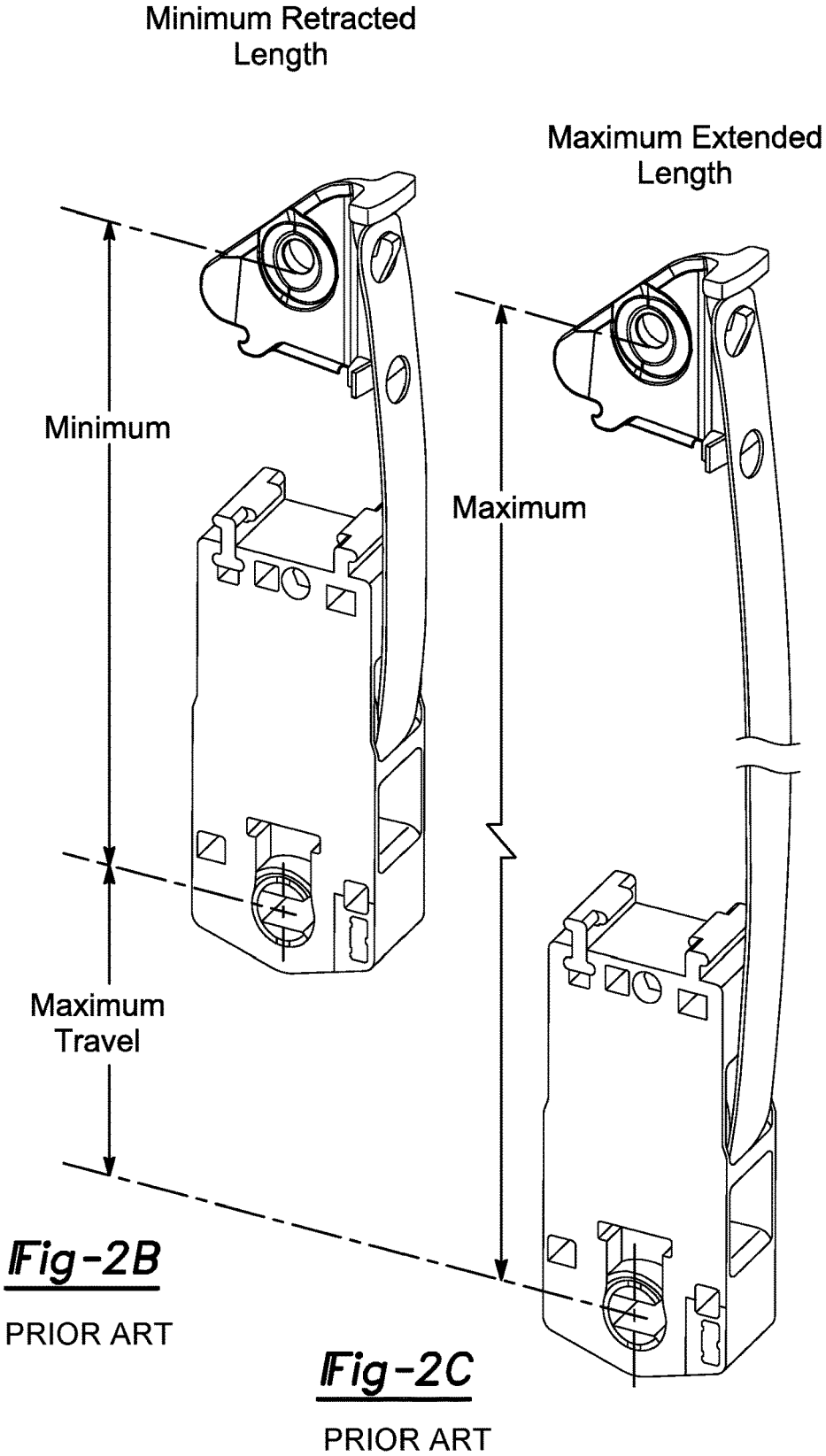
Fig-2B PRIOR ART
Fig-2C PRIOR ART
FIG. 2B shows a moving-coil, constant force window balance at a minimum retracted length.
FIG. 2C shows a moving-coil, constant force window balance at a maximum extended length.
Figure 3:
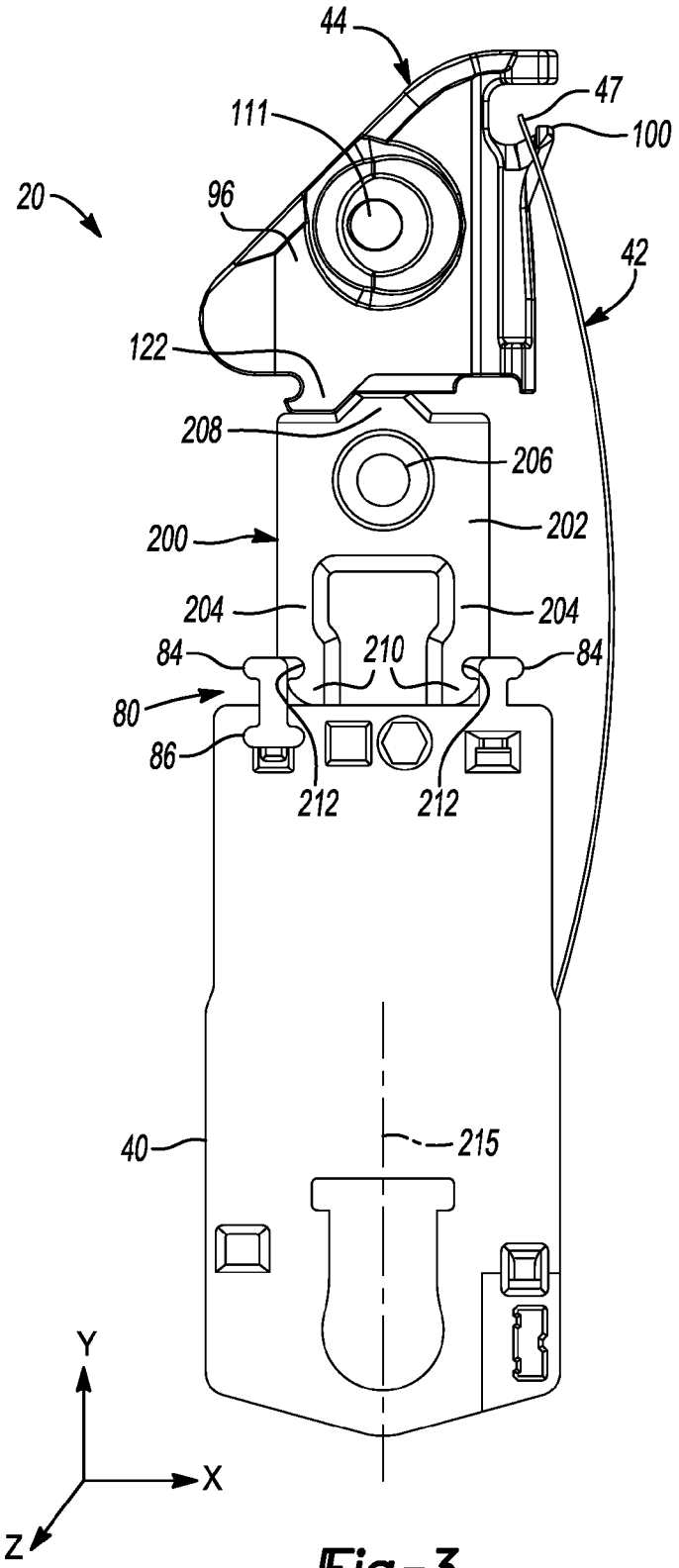
FIG. 3 is a front view of one embodiment of a moving-coil, constant force window balance assembly according to the present disclosure.
Figure 4:
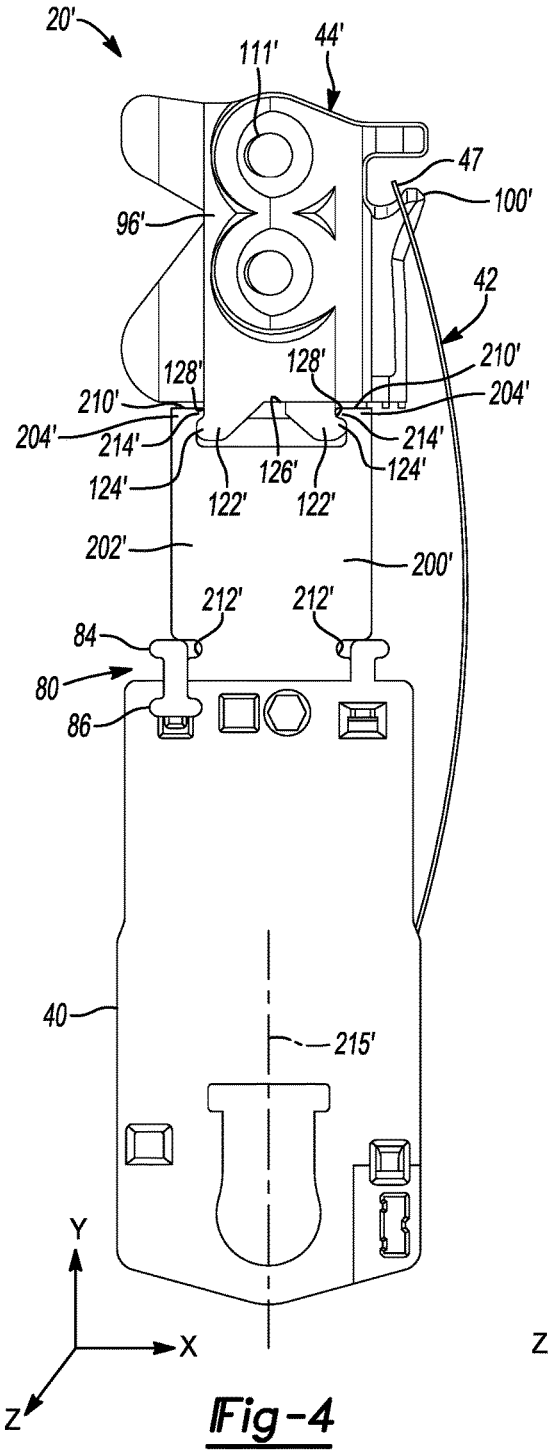
FIG. 4 is a front view of another embodiment of a moving-coil, constant force window balance assembly according to the present disclosure.

Referring generally to FIGS. 3 and 4, window balance assemblies 20, 20' of the present disclosure is shown to further include a sash support bracket 200, 200' that can be formed from a polymeric material. The sash support bracket 200, 200' is positioned intermediate of the carrier 40 and the mounting bracket 44, 44'. The purpose of the sash support bracket 200, 200' is to supplement the counter-balance or holding force provided by the curl spring 42 of the window balance assembly 20, 20' against the weight of the window sash when the sash is in a raised position (e.g., a lower sash 14 in a raised and open position, or an upper sash 12 in a raised and closed position). The supplemental counter-balance or holding force serves to help prevent the sash 12, 14 from drifting downward under the force of gravity. This is particularly a concern when raising the sash 12, 14 results in the curl spring 42 being retracted to a length such that the biasing force generated by the curl spring 42 is less than the rated force for the curl spring 42 (i.e., less than a minimum retracted length, as shown in FIG. 2B).

Referring specifically to FIG. 3, a window balance assembly 20 according to one embodiment of the present disclosure is provided. The window balance assembly 20 includes a carrier 40 and curl spring 42 (both generally as previously described), a mounting bracket 44, and a sash support bracket 200. In the configuration of the window balance assembly 20 shown in FIG. 3, the carrier 40, sash support bracket 200 and mounting bracket 44 are connected. In this respect, the carrier 40 is joined or coupled to the sash support bracket 200, the mounting bracket 44 is positioned on top of the sash support bracket 200, and the uncurled portion 47 of the curl spring 42 is attached to the mounting bracket 44, as further described below.

The mounting bracket 44 may be formed from a polymeric material, for example, and may include a body portion 96. The body portion 96 may include a hook 100 and one or more counter-bored or countersunk mounting apertures 111 which enable the mounting bracket 44 to be attached to a wall of the jamb channel 26 via a screw or other fastener means in a well-known manner. The hook 100 may extend generally upwardly and outwardly from the body portion 96 and may engage an aperture in the uncurled portion 47 of the curl spring 42. The mounting bracket 44 can include an integrally formed tab 122 that can project from a base at the lower end of the body portion 96.

The sash support bracket 200 is shown to include a body portion 202 and two projecting leg portions 204 extending vertically downwardly from the body portion 202 toward the carrier 40. The sash support bracket 200 body portion 202 also includes at least one counter-bored or countersunk mounting aperture 206 near a center of the body portion 202. The mounting aperture 206 enables the sash support bracket 200 to be attached to the jamb wall by a screw or other fastener in a manner similar to the mounting bracket 44. An upper end 208 of the body portion 202 abuts or nests with the base or lower end of the mounting bracket 44.

The leg portions 204 are cantilevered from the upper body portion 202. The distal end 210 of each of the leg portions 204 of the sash support bracket 200 includes a recess 212 that corresponds to a shape and contour of the projection 80 on the carrier 40. The recesses 212 enable the leg portions 204 to fit snugly over and around and capture the projections 80. The leg portions 204, however, are resiliently and elastically flexible or deformable at least in a plane that is generally parallel to an exterior face of the carrier 40 (i.e., the X-Y plane of FIG. 3). The sash support bracket 200, therefore, can connect to the carrier 40, such as shown in the window balance assembly 20 of FIG. 3. The connection, however, is an operably separable connection due to the flexibility of the cantilevered leg portions 204 and the relative rigidity of the projections 80. Thus, the sash support bracket 200 can be disconnected from the carrier 40 responsive to a force directed downwardly along the Y-axis of FIG. 3 (e.g., in addition to gravity) such as could be applied by the user when manually lowering the sash 14 toward a closed position. Under such force, one or both of the leg portions 204 deflects inwardly toward the vertical centerline 215 of the balance assembly 20 to enable the projections 80 to escape the recesses 212 at the distal ends 210 of the leg portions 204 of the sash support bracket 200.

In addition, and in a corresponding manner, when the lower sash 14 is in a raised and open position, the sash support bracket 200 (i.e., at the leg portions 204) engages the carrier 40 (i.e., at the projections 80) such that the carrier 40 becomes removably connected to the sash support bracket 200. In such a condition, the sash support bracket 200, which is fastened to the jamb wall, supplements the counter-balance or holding force of the window balance assembly 20 against the weight of, e.g., the lower sash 14. Moreover, the supplemental counter-balance or holding force provided by the sash support bracket 200 can be varied or "tuned" to the particular requirements or circumstances of the window assembly 10 in which the window balance assembly 20 is installed (e.g., size and weight of the sash 14, force rating of the curl spring 42, etc.). More particularly, the supplemental counter-balance or holding force can be varied by changing (e.g., increasing or decreasing) the resiliency of one or both of the projecting leg portions 204 of the sash support bracket 200.

In addition, when the sash support bracket 200 engages (e.g., couples to) and/or disengages (e.g., uncouples from) the carrier 40, an indication is generated, such as an audible and/or tactile response, to provide feedback to a user of the window balance assembly 20 that the sash support bracket 200 has engaged and/or disengaged from the carrier 40. Such feedback can, e.g., indicate to the user the position of the sash 14.

Turning now to FIG. 4, a window balance assembly 20' according to another embodiment of the present disclosure is provided. The window balance assembly 20' includes a carrier 40 and curl spring 42 (both generally as previously described), a mounting bracket 44', and a sash support bracket 200'. In the configuration of the window balance assembly 20' shown in FIG. 4, the carrier 40, the sash support bracket 200' and mounting bracket 44' are connected. In this respect, the carrier 40 is joined or coupled to the sash support bracket 200', the mounting bracket 44' is connected to the sash support bracket 200', and the uncurled portion 47 of the curl spring 42 is attached to the mounting bracket 44', as further described below.

The mounting bracket 44' may be formed from a polymeric material, for example, and may include a body portion 96'. The body portion 96' may include a hook 100' and one or more counter-bored or countersunk mounting apertures 111' which enable the mounting bracket to be attached to a wall of the jamb channel 26 via a screw or other fastening means in a well-known manner. The hook 100' may extend generally upwardly and outwardly from the body portion 96' and may engage an aperture in the uncurled portion 47 of the curl spring 42. The mounting bracket 44' can include an attachment portion integrally formed with the body portion 96'. The attachment portion may include a pair of integrally-formed, downwardly-extending tabs 122' having outwardly directed curved ends 124' that project from the lower surface 126' of the body portion 96' and create recesses 128' between the tabs 122' and a base at the lower end of the mounting bracket 44'.

The sash support bracket 200' is shown to include a body portion 202' and two projecting leg portions 204' extending vertically upwardly from an upper end of the body portion 202' toward the mounting bracket 44'. The leg portions 204' are cantilevered from the upper body portion 202'. The distal end 210' of each of the leg portions 204' of the sash support bracket 200' includes an inwardly directed projection 214' that nests within the recesses 128' at the curved ends 124' of the tabs 122' of the mounting bracket 44'. The projections 214' of the leg portions 204' to fit snugly into the recesses 128' of the mounting bracket 44'. The leg portions 204', however, are resiliently and elastically flexible or deformable at least in a plane parallel to an exterior face of the carrier, (i.e., the X-Y plane of FIG. 4). The sash support bracket 200' can, therefore, be connected to the mounting bracket 44', such as shown in the window balance assembly 20' of FIG. 4. The connection, however, is an operably separable connection due to the flexibility of the cantilevered leg portions 204' and the relative rigidity of the tabs 122' of the mounting bracket 44'. Thus, the sash support bracket 200' can be disconnected from the mounting bracket 44' responsive to a force (e.g., in addition to gravity) directed downwardly along the Y-axis of FIG. 4 such as could be applied by the user when manually lowering the sash 14. Under such force, one or both of the leg portions 204' deflects inwardly toward the vertical centerline 215' of the balance assembly 20' to enable the projections 214' at the distal ends 210' of the leg portions 204' of the sash support bracket 200' to escape the recesses 128' at the curved ends 124' of the tabs 122' of the mounting bracket 44'.

The sash support bracket 200' body portion 202' also includes, at a lower end opposite the leg portions 204', a pair of recesses 212' each of which corresponds to a shape and contour of a projection 80 on the carrier 40. The recesses 212' of the sash support bracket 200' fit snugly over and around the projections 80 in the configuration of the window balance assembly 20' shown in FIG. 4. The projections 80 of the carrier 40 can engage the recesses 212' of the sash support bracket 200' slidably in a direction perpendicular to an exterior face of the carrier 40 (i.e., the direction of the Z-axis of FIG. 4). Once engaged, the sash support bracket 200' and carrier 40 are operably assembled by a secure interconnection, in contrast to the operably separable connection between the sash support bracket 200' and the mounting bracket 44'. Therefore, in the window balance assembly 20', the sash support bracket 200' travels with the carrier 40 as the carrier 40 moves up and down within the jamb channel 26 during operation of the window balance assembly.

Similarly as discussed above, when the lower sash 14 is raised to a fully open position, the sash support bracket 200' (i.e., at the leg portions 204') engages the mounting bracket 44' (i.e., at the tabs 122') such that the sash support bracket 200' and carrier 40 combination become removably connected to the mounting bracket 44'. The sash support bracket 200', when connected to the mounting bracket 44' which is, in turn, fastened to the jamb wall, supplements the counter-balance or holding force of the window balance assembly 20' against the weight of, e.g., the lower sash 14. Moreover, the supplemental counter-balance or holding force provided by the sash support bracket 200' can be varied to the particular requirements or circumstances of the window assembly, e.g., by increasing or decreasing the resiliency of one or both of the projecting leg portions 204' of the sash support bracket 200'. In addition, when the sash support bracket 200' engages (e.g., couples to) and/or disengages (e.g., uncouples from) the mounting bracket 44', an indication by way of an audible and/or tactile response can be generated to provide feedback to a user of the window balance assembly 20' that the sash support bracket 200' has engaged and/or disengaged from the mounting bracket 44'. Such feedback can, e.g., indicate to the user the position of the sash.

Figure 5:
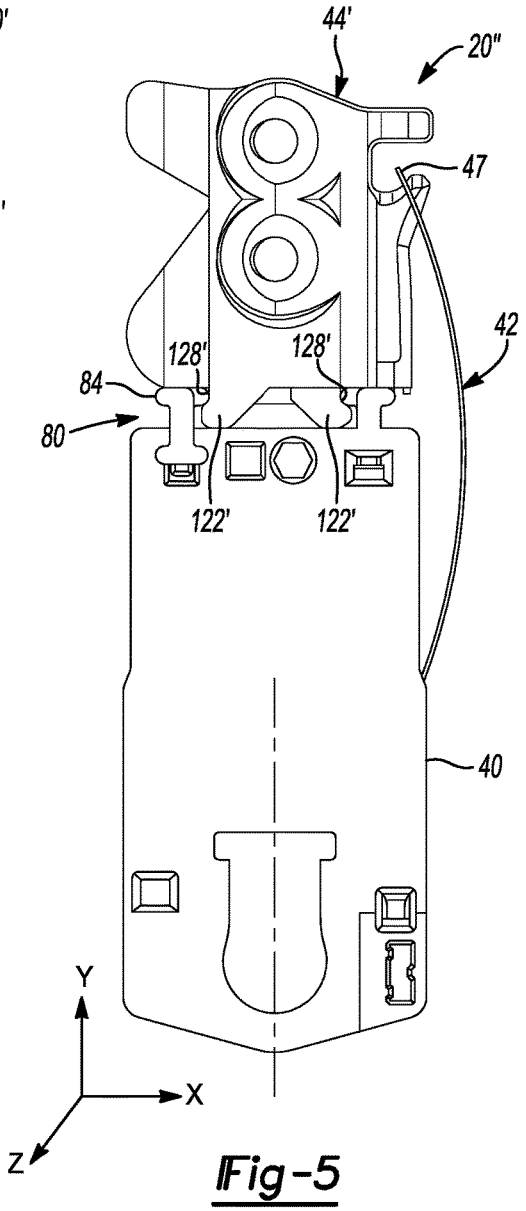
FIG. 5 is a front view of still another embodiment of a moving-coil, constant force window balance assembly according to the present disclosure.

Referring to FIG. 5, still another embodiment of a window balance assembly 20" according to the present disclosure is provided. The window balance assembly 20" includes a carrier 40 and curl spring 42 (both generally as previously described) and a mounting bracket 44', as described with respect to the window balance assembly 20' shown in FIG. 4. This embodiment of a window balance assembly 20" is more simplified that the above-described embodiments in that it foregoes a sash support bracket 200, 200'.

Similarly as discussed above, the mounting bracket 44' of window balance assembly 20" may be formed from a resilient polymeric material, for example, and may include a body portion 96'. The body portion 96' may include a hook 100' and one or more counter-bored or countersunk mounting apertures 111' which enable the mounting bracket 44' to be attached to a wall of the jamb channel 26 via a screw or other fastening means in a well-known manner. The hook 100' may extend generally upwardly and outwardly from the body portion 96' and may engage an aperture in the uncurled portion 47 of the curl spring 42.

The mounting bracket 44' can include an attachment portion integrally formed with the body portion 96'. The attachment portion may include a pair of integrally-formed, downwardly extending tabs 122' having outwardly directed curved ends 124' that project from the lower surface 126' of the body portion 96' and create recesses 128' between the tabs 122' and a base at the lower end of the mounting bracket 44'.

In the window balance assembly 20" of FIG. 5, however, the mounting bracket 44' can be connected directly to the carrier 40, such as shown in the configuration of the window balance assembly 20" of FIG. 5. In this respect, the projections 80 of the carrier 40 nest within the recesses 128' between the tabs 122' and the base of the mounting bracket 44'. The projections 80 of the carrier 40 fit snugly into the recesses 128' of the mounting bracket 44'. When the carrier 40 is connected to the mounting bracket 44' which is, in turn, fastened to the jamb wall, the counter-balance or holding force of the window balance assembly 20" is supplemented to better resist the weight of, e.g., the lower sash 14.

The connection, however, is an operably separable connection. Thus, in a manner similar to that previously described, the mounting bracket 44' can be disconnected from the carrier 40 responsive to a force in a direction along the Y-axis of FIG. 5 (e.g., in addition to gravity), such as could be applied by the user when manually lowering the sash 14. In the window balance assembly 20" of FIG. 5, under such force one or both of the tabs 122' or one or both of the projections 80 is resiliently and elastically flexible or deformable in a plane parallel to an exterior face of the carrier, (i.e., the X-Y plane of FIG. 5).

It should be appreciated that although the above-described window balance assemblies are discussed in the context of a lower sash of a hung window, they are equally applicable for use with the upper sash of a double hung window.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A moving coil, constant force, curl spring window balance assembly for installation in a hung window assembly comprising a sash moveable between a raised position and a lowered position, the window balance assembly comprising:

a mounting bracket configured to be fixedly attached to a jamb wall of the window assembly;

a carrier slidably coupled to the mounting bracket, the carrier comprising a pair of projections;

a curl spring having a first curled portion and a second uncurled portion, the first portion being coupled to the carrier and the second portion being coupled to the mounting bracket, the curl spring configured to provide a counter-balance force against a weight of the sash; and a sash support bracket comprising a pair of resilient leg portions, the sash support bracket positioned intermediate the carrier and the mounting bracket, the sash support bracket configured to be nested with the mounting bracket and configured to be fixedly attached to the jamb wall;

wherein when the sash is in the raised position the pair of resilient leg portions of the sash support bracket is configured to operatively couple to the pair of projections of the carrier to provide a holding force to supplement the counter-balance force provided by the curl spring against the weight of the sash, and when the sash is moved from the raised position toward the lowered position the sash support bracket is configured to operatively uncouple from the carrier.

2. The window balance assembly of claim 1, wherein the sash support bracket is configured to produce at least one of an audible and a tactile feedback upon movement of the sash to at least one of the raised position and the lowered position.

3. The window balance assembly of claim 2, wherein the sash support bracket is configured to produce the at least one of an audible and a tactile feedback upon at least one of the operatively coupling and operatively uncoupling of the sash support bracket to the carrier.

4. The window balance assembly of claim 1, wherein the sash support bracket comprises a body portion and the pair of resilient leg portions extends vertically downwardly from the body portion toward the carrier.

5. The window balance assembly of claim 4, wherein the sash support bracket body portion further comprises at least one aperture near a center of the body portion configured to receive a fastener for attaching the sash support bracket to the jamb wall of the window assembly.

6. The window balance assembly of claim 4, wherein an upper end of the body portion abuts a base at a lower end of the mounting bracket.

7. The window balance assembly of claim 4, wherein the pair of resilient leg portions are cantilevered from the body portion.

8. The window balance assembly of claim 7, wherein the pair of projections is on an upper end of the carrier;

wherein a distal end of each of the leg portions of the sash support bracket includes a recess that corresponds to a shape of each respective projection; and wherein the recesses are configured to fit snugly over and around the respective projections when the sash is in the raised position and the sash support bracket is operatively coupled to the carrier.

9. The window balance assembly of claim 8 wherein the leg portions are resiliently flexible.

10. The window balance assembly of claim 8 wherein the leg portions are resiliently flexible in a plane parallel to an exterior face of the carrier.

11. The window balance assembly of claim 9 wherein a magnitude of the holding force is variable by changing a resiliency of one or both of the leg portions of the sash support bracket.

12. The window balance assembly of claim 1, wherein the sash support bracket comprises a body portion;

wherein the body portion comprises at least one aperture near a center of the body portion configured to receive a fastener for attaching the sash support bracket to the jamb wall of the window assembly.

13. The window balance assembly of claim 12, wherein the sash support bracket is configured to produce at least one of an audible and a tactile feedback upon at least one of the operatively coupling and operatively uncoupling of the sash support bracket to the carrier.

14. The window balance assembly of claim 13 wherein a magnitude of the holding force can be varied by changing a resiliency of at least one of the pair of leg portions of the sash support bracket.

* * * * *